US006951482B1

(12) United States Patent
Miller et al.

(10) Patent No.: US 6,951,482 B1
(45) Date of Patent: Oct. 4, 2005

(54) CONTROLLED-IMPEDANCE COAXIAL CABLE INTERCONNECT SYSTEM

(75) Inventors: Will A. Miller, Vancouver, WA (US); David R. Trine, Portland, OR (US)

(73) Assignee: Credence Systems Corporation, Milpitas, CA (US)

( * ) Notice: Subject to any disclaimer, the term of this patent is extended or adjusted under 35 U.S.C. 154(b) by 54 days.

(21) Appl. No.: 10/802,993

(22) Filed: Mar. 16, 2004

(51) Int. Cl.[7] ..... H01R 9/05
(52) U.S. Cl. ..... 439/581; 439/63; 439/66
(58) Field of Search ..... 439/581, 63, 66, 439/578, 579

(56) References Cited

U.S. PATENT DOCUMENTS 4,734,046 A * 3/1988 McAllister et al. ..... 439/101
6,824,427 B1 * 11/2004 Feldman et al. ..... 439/581

* cited by examiner

*Primary Examiner*—Ross Gushi
(74) *Attorney, Agent, or Firm*—John Smith-Hill; Smith-Hill and Bedell

(57) ABSTRACT

An interconnection structure includes a positioning block and a dielectric substrate. A coaxial cable has an end segment that is fitted in a passage in the positioning block and the positioning block is so positioned relative to the dielectric substrate that an end face of the inner conductor of the coaxial cable is presented towards a conductive element on a main face of the substrate. A discrete resilient contact element is interposed between the end face of the inner conductor and the conductive element and in electrically-conductive pressure contact with both the inner conductor and the conductive element.

17 Claims, 3 Drawing Sheets

CONTROLLED-IMPEDANCE COAXIAL CABLE INTERCONNECT SYSTEM

BACKGROUND OF THE INVENTION

This invention relates to a controlled-impedance coaxial cable interconnect system.

Referring to FIG. 1, a conventional semiconductor integrated circuit tester includes multiple tester channels 2 each having an I/O terminal for connection through a signal path 6 to a terminal of an integrated circuit device under test (DUT) 10 for supplying a stimulus signal to, or receiving a response signal from, the DUT.

It is necessary that the signal paths 6 should have sufficient bandwidth to propagate the test signals (stimulus and response signals) between the DUT terminals and the I/O terminals of the tester channels without undue degradation. Accordingly, it is conventional to implement the signal paths 6 with transmission line structures. As the frequency of operation of integrated circuits increases, the frequencies of the test signals that are utilized in evaluating an integrated circuit device increase and accordingly the bandwidth of the signal paths 6 must increase. It is well known that a transmission line structure of which the characteristic impedance is uniform throughout its length will have a higher bandwidth than a transmission line structure of which the characteristic impedance varies significantly over its length.

FIG. 2 shows a portion of the conventional tester in more detailed, but still highly schematic, form. FIG. 2 illustrates a device interface board (DIB) 14 that is provided on one surface with a socket (not shown) for receiving the DUT in packaged form and having multiple contact pads 18 exposed at its other surface and connected through conductive traces of the DIB to respective terminals of the socket. The DIB is illustrated in FIG. 2 in a horizontal orientation with the contact pads 18 on the lower surface of the DIB. In this case, the DUT socket would be on the upper surface of the DIB. It will be appreciated by those skilled in the art that this choice of orientation of the DIB 14 is for the sake of convenience and that other orientations may be employed. It will also be appreciated that although, for convenience, only one socket has been referred to, for receiving a single integrated circuit device for testing, it is common to provide multiple sockets on a single DIB for concurrent testing of multiple integrated circuit devices.

The pads 18 are arranged in several discrete groups on the lower surface of the DIB and the tester includes a positioning block 22 for each group of pads 18. The positioning blocks may be mounted in a carrier that is restrained against horizontal movement relative to the DIB and is displaceable vertically relative to the DIB by a force mechanism (not shown). The positioning block 22 is formed with multiple apertures 26 aligned with the pads 18 respectively.

The portion of the signal path between a pad 18 of the DIB and the I/O terminal of the corresponding tester channel 2 is implemented by a coaxial transmission line structure. The coaxial transmission line structure includes a coaxial cable 28 that is composed of an inner conductor 30, an outer shield conductor 32 spaced from the inner conductor, dielectric material 34 between the inner conductor and the outer conductor, and an insulating jacket 38. The coaxial cable 28 is connected at one end to the terminal of the tester channel 2 and is provided at its opposite end with a pogo pin connector 42 that includes a cylindrical metal fitting 46 in electrically conductive contact with the outer conductor 32 of the cable, a dielectric sleeve 50 in the metal fitting, and a spring probe pin 54, commonly referred to as a pogo pin, mounted in an axial bore in the dielectric sleeve. The conventional pogo pin, which is shown in simplified form in FIG. 2, includes a metal barrel 56 having an internal stop 58, a plunger 60 that is a sliding fit inside the barrel and is captive within the barrel, and a spring 62 effective between the internal stop and the plunger for urging the plunger toward a projecting position. The inner conductor 30 of the cable 28 is fitted in the open end of the metal barrel 56, and the barrel 56 and the spring 62' provide an electrically conductive connection between the inner conductor 30 and the plunger 60.

The pogo pin connector 42 is secured in an aperture 26 in the positioning block. As shown in FIG. 2, the tip of the plunger 60 projects above the upper surface of the positioning block. When the carrier is displaced upwards by the force mechanism, the tip of the plunger engages the contact pad 18 and accordingly the pogo pin provides an electrically conductive connection between the inner conductor 30 and the contact pad 18. Ground connections are provided between the outer conductor 32 and the ground traces of the DIB by pogo pins 68 that are secured directly in the positioning block, without interposition of dielectric material, and engage contact pads 70 that are connected to the ground traces of the DIB.

The characteristic impedance of a coaxial transmission line is a function of the dielectric constant of the dielectric material and the ratio of the external diameter of the inner conductor to the internal diameter of the outer conductor.

Conventionally, the DIB is manufactured so that the segments of the signal path within the DIB are of uniform 50 ohm characteristic impedance and the coaxial cables that connect the I/O terminals of the tester channels to the pogo pin connectors 42 are of uniform 50 ohm characteristic impedance. The portion of the interconnect system shown in FIG. 2 between the DUT end of the coaxial cable and the contact pad 18 of the DIB is designed to approximate a coaxial transmission line having a uniform characteristic impedance of 50 ohms.

The interconnect system shown in FIG. 2 is satisfactory for many purposes, but it can be seen that there is potential for discontinuities in characteristic impedance of the signal path due to variations in geometry of the conductors and variations in dielectric constant of the dielectric material between the conductors of the coaxial transmission line structure.

As integrated circuits have increased in complexity, the number of terminals of IC devices has increased and in order to avoid increasing the size of the DIB to accommodate additional contact pads, it has become desirable to pack the signal pads 18 more densely on the DIB. This in turn necessitates that the pogo pin connectors 42 be packed more densely in the positioning block. In a practical implementation of the interconnect system that is shown in FIG. 2, the positioning block 22 is provided with apertures for receiving sixteen pogo pin connectors 42 for accessing an array of sixteen signal pads 18, as shown in FIG. 3. The density with which the connectors 42 can be packed is limited by the physical dimensions of the connector 42 and coaxial cable 28, which are relatively large in diameter in part because the dielectric constant of the dielectric material necessitates that the outer conductor be of substantially greater diameter than the inner conductor in order to provide the desired 50 ohm characteristic impedance.

Coaxial cable in which air is the principal dielectric material between the inner and outer conductors is commercially available. Because the dielectric constant of air is much lower than that of the synthetic dielectrics (such as PTFE) that have hitherto been commonly used in coaxial cables, in an air dielectric cable the ratio of the internal diameter of the outer conductor to the diameter of the inner conductor can be substantially less than in a coaxial cable that employs a synthetic dielectric as the principal dielectric material and accordingly for a given diameter of the inner conductor, the thickness of the cable can be substantially less.

One type of air dielectric coaxial cable is known as air dielectric microfilament coaxial cable. Air dielectric microfilament coaxial cable typically comprises an inner conductor, a thin-walled tube of PTFE inside the outer conductor and of internal diameter greater than the external diameter of the inner conductor, a coil of fine PTFE filament material wound around the inner conductor in the space between the inner conductor and the PTFE tube to maintain a uniform spacing between the inner and outer conductors, and a protective jacket of insulating material.

Several interconnect technologies have been developed for providing electrical contact between closely spaced pins of an integrated circuit device and a corresponding array of conductive lands on a dielectric substrate. Such technologies include the ball grid array and the land grid array. A typical land grid array comprises a precision molded retaining member made of dielectric material and formed with apertures distributed in a rectangular array corresponding to the array of conductive lands on the dielectric substrate. Each aperture contains a spring contact. When the contact device is clamped between the integrated circuit device and the dielectric substrate, the spring contact elements enter electrically conductive pressure contact with the conductive lands on the substrate and the corresponding pins of the integrated circuit device. A land grid array that employs C-shaped spring contacts is commercially available under the designation InterCon cLGA.

SUMMARY OF THE INVENTION

In accordance with a first aspect of the invention there is provided an interconnection structure including a positioning member having a main face and formed with a passage that opens at said main face, a dielectric substrate having a first conductive element on a main face thereof, a coaxial cable having an inner conductor, an outer conductor, and dielectric material between the inner conductor and the outer conductor, wherein the coaxial cable has an end segment that is fitted in the passage in the positioning member and the positioning member is so positioned relative to the dielectric substrate that an end face of the inner conductor is presented towards the first conductive element, and a discrete resilient contact element interposed between the end face of the inner conductor and the first conductive element and in electrically-conductive pressure contact with both the inner conductor and the first conductive element.

In accordance with a second aspect of the invention there is provided an interconnection structure including a positioning member having a main face and formed with a plurality of passages that open at said main face, a dielectric substrate having a plurality of first conductive elements on a main face thereof, the main face of the dielectric substrate being presented towards the main face of the positioning member, a plurality of coaxial cables each having an inner conductor, an outer conductor, and dielectric material between the inner conductor and the outer conductor, wherein each coaxial cable has an end segment that is fitted in a passage in the positioning member and the inner conductors of the coaxial cables have respective end faces that are presented towards the first conductive elements respectively, and a plurality of first discrete resilient contact elements interposed between the end faces of the inner conductors respectively and the first conductive elements respectively.

In accordance with a third aspect of the invention there is provided an interconnection structure including an electrically-conductive positioning member having a main face and formed with a plurality of passages that open at said main face, and a plurality of coaxial cables each having an inner conductor, an outer conductor, and dielectric material between the inner conductor and the outer conductor, wherein the coaxial cables have respective end segments that are respectively fitted in the passages in the positioning member and the inner conductors are substantially flush with the main face of the positioning member.

In accordance with a fourth aspect of the present invention there is provided an interconnection structure comprising a first positioning member having a main face and formed with a plurality of passages that open at said main face, a first plurality of conductors having respective end segments that are respectively fitted in the passages in the first positioning member and are substantially flush with the main face of the first positioning member, a second positioning member having a main face and formed with a plurality of passages that open at said main face, a second plurality of conductors having respective end segments that are respectively fitted in the passages in the second positioning member and are substantially flush with the main face of the second positioning member, a means for securing the first and second positioning members with their respective main faces in confronting relationship, and a plurality of discrete resilient contact elements interposed between the main faces of the first and second positioning members and each in electrically conductive pressure contact with one conductor of the first plurality and one conductor of the second plurality.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 4:
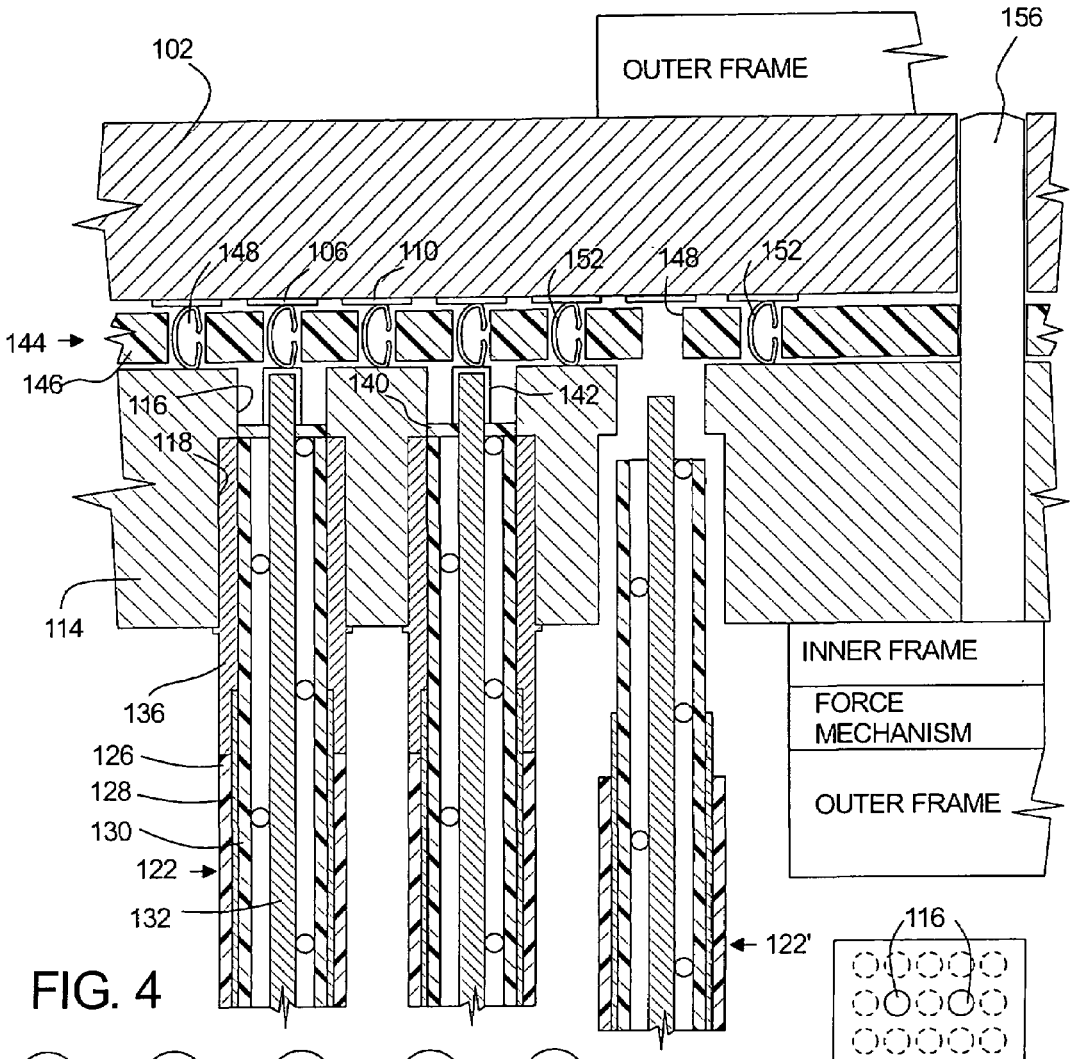
FIG. 4 is a partial enlarged sectional view of an interconnect system embodying the present invention.
Figure 6:
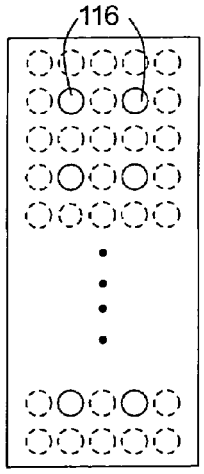
FIG. 6 is a plan view of the positioning block of the interconnect system shown in FIG. 4.
Figure 5:
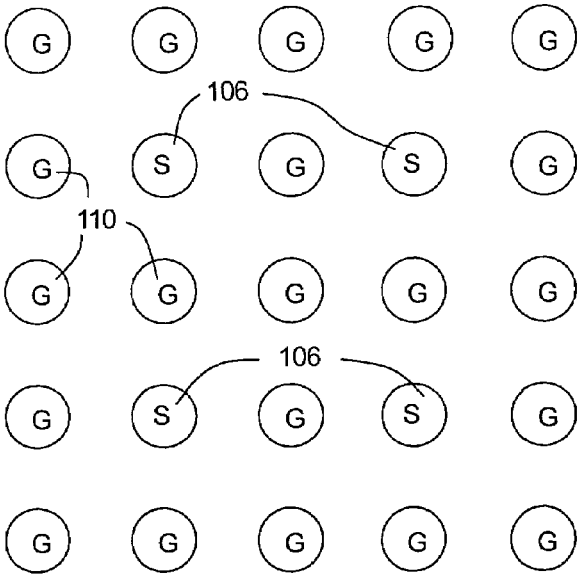
FIG. 5 is a partial bottom plan view of the DIB that is used with the interconnect system shown in FIG. 4.

FIGS. 4–6 illustrate an interconnect system for linking a tester channel to a conductive signal trace of a DIB 102. The DIB is provided at its lower surface with several signal contact pads 106 that are connected through respective traces (not shown) to the terminals of a socket on the upper surface of the DIB. The signal pads are arranged in several discrete groups, and in each group the signal pads are arranged in two rows. See FIG. 5. The DIB is also provided at its lower surface with numerous ground contact pads 110 that are connected to a ground conductor of the DIB. The ground pads 110 are arranged in several groups, corresponding to the groups of signal pads, and in each group the ground pads are arranged in three rows. The arrangement is such that each signal pad 106 is at the center of a square having a ground pad 110 at each corner and a ground pad 110 at the center of each side of the square.

The interconnect system shown in FIGS. 4–6 includes a positioning block 114 formed with multiple passages each having a relatively narrow bore 116 and a somewhat wider counter bore 118. The passages in the positioning block are in two rows, and the spacing between the rows of passages is equal to the spacing between the rows of signal pads 106 shown in FIG. 5. The spacing between adjacent passages in each row is equal to the spacing between the two rows of passages.

The tester includes an outer frame, which is shown only schematically, and the DIB is restrained against upward movement by the outer frame. The positioning block 114 is mounted in an inner frame or carrier and a force mechanism is effective between the outer frame and the inner frame for forcing the positioning block upwards relative to the DIB 102.

A length of air dielectric microfilament coaxial cable 122 is connected at one end to the I/O terminal of a tester channel. The opposite end, or DUT end, of the cable is prepared by stripping the outer jacket 126, the outer conductor 128 and the inner PTFE tube 130 so that the inner conductor 132 projects slightly beyond the inner tube 130, the inner tube projects beyond the outer conductor 128 and the outer conductor projects beyond the outer jacket 126, as shown in FIG. 4 for the cable 122'. A metal sleeve 136, whose internal diameter is substantially equal to the internal diameter of the outer conductor, is fitted over the PTFE tube. The interior of the sleeve 136 is slightly enlarged at its leading end (with respect to fitting over the PTFE tube) and accordingly the leading end of the sleeve fits tightly over the outer conductor 128, providing an electrically conductive connection between the outer conductor and the metal sleeve. The trailing end of the metal sleeve is substantially flush with the end of the PTFE tube. An annular centering disc 140 of dielectric material fits over the projecting end of the inner conductor and a metal cap 142 is press fit onto the end of the inner conductor and holds the centering disc 140 and the metal sleeve 136 in position on the DUT end of the coaxial cable 122.

The DUT end of the coaxial cable, prepared in this manner, is inserted in the counter bore 118 and an external flange of the metal sleeve 136 seats against the lower surface of the positioning block. The metal sleeve is secured to the positioning block. The dimensions of the positioning block and of the sleeve 136 and centering disc 140 are such that the end face of the metal cap 142 is substantially flush with the upper surface of the positioning block 114. The centering disc holds the inner conductor centrally within the bore 116 in the positioning block.

The interconnect system further includes a contact device 144 employing a land grid array. The contact device comprises a precision molded dielectric retaining member 146 formed with apertures 148 distributed in a square array at a spacing that is one-half of the spacing of the ends of the coaxial cables at the upper surface of the positioning block. Resilient contact elements 152 are located in the apertures 148 respectively. As shown in FIG. 4, the resilient contact elements 152 are in the form of C-shaped spring elements. The dielectric retaining member 146 is aligned relative to the passages in the positioning block by alignment pins 156 that project from the positioning block and pass through alignment bores in the dielectric retaining member and enter alignment bores in the DIB 102. Engagement of the alignment pins 156 in the alignment bores of the dielectric retaining member and in the alignment bores of the DIB results in the dielectric retaining member being positioned so that there is one contact element 152 between the end of each coaxial cable and the corresponding signal pad 106 of the DIB and there is one contact element 152 between the positioning block and each ground pad 110 of the DIB. When the positioning block and DIB are urged together by the force mechanism, the contact elements establish electrical connections between the ends of the coaxial cables and the respective signal pads of the DIB and between the positioning block and the ground pads of the DIB. The contact device 144 provides a controlled impedance connection having a 50 ohm characteristic impedance between the tip of the inner conductor of each coaxial cable and the corresponding signal pad 106. FIG. 6 illustrates the bores 116 with solid lines and the regions of the positioning block that are engaged by the contact elements that engage the ground pads of the DIB with dashed lines.

By appropriately selecting the dielectric material of the centering disc 140 and selecting the dimensions of the passages in the positioning block, it is possible to provide a characteristic impedance that varies only slightly from 50 ohms over the entire length of the signal path between the terminal of the tester channel and the tip of the inner conductor of the coaxial cable.

Figure 1:
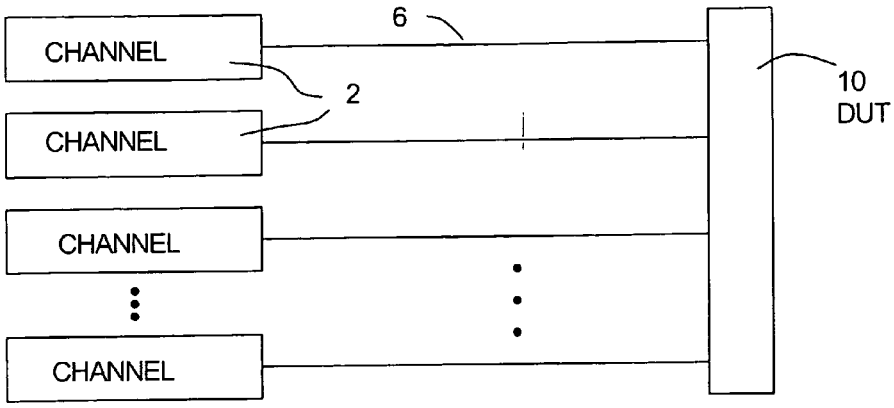
FIG. 1 PRIOR ART
FIG. 1 is a schematic illustration of a semiconductor integrated circuit tester.
Figure 2:
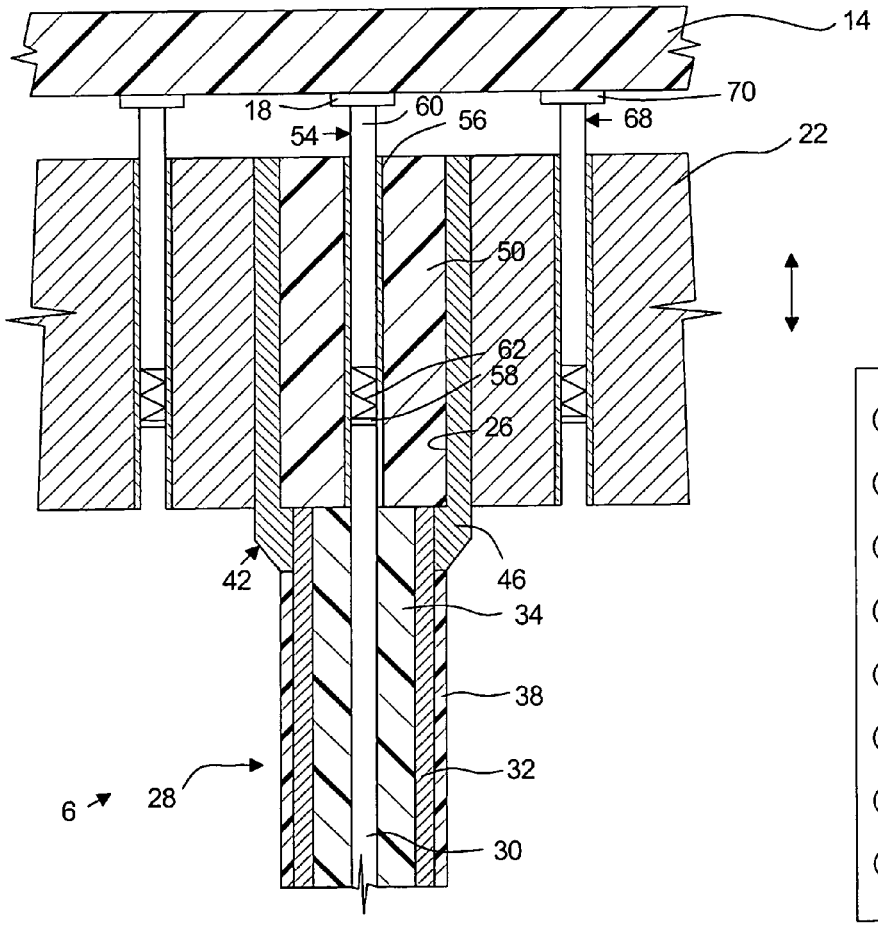
FIG. 2 PRIOR ART
FIG. 2 is an enlarged partial sectional view of an interconnect system in accordance with the prior art.
Figure 3:
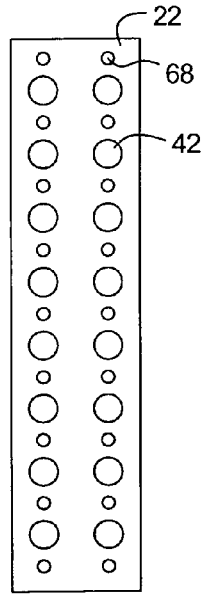
FIG. 3 PRIOR ART
FIG. 3 is a plan view of the positioning block shown in FIG. 2.

In an implementation of the invention, it has been found possible to pack 2 mm diameter air dielectric microfilament coaxial cables in the positioning block at a center-to-center spacing as small as 2 mm, which is substantially less than the minimum spacing that can be achieved with the structure described with reference to FIGS. 1–3 and allows as many as 36 cables to be held in a positioning block that is of substantially the same size as the block shown in FIG. 3.

Although it is convenient to provide one ground contact element between each two signal contact elements that engage the tips of respective coaxial cables, it will be appreciated that by suitably selecting the spacing between the ground contact elements relative to the spacing between the passages in the positioning block it would be possible to provide more than one ground contact element between each two adjacent signal contact elements in a row.

Figure 7:
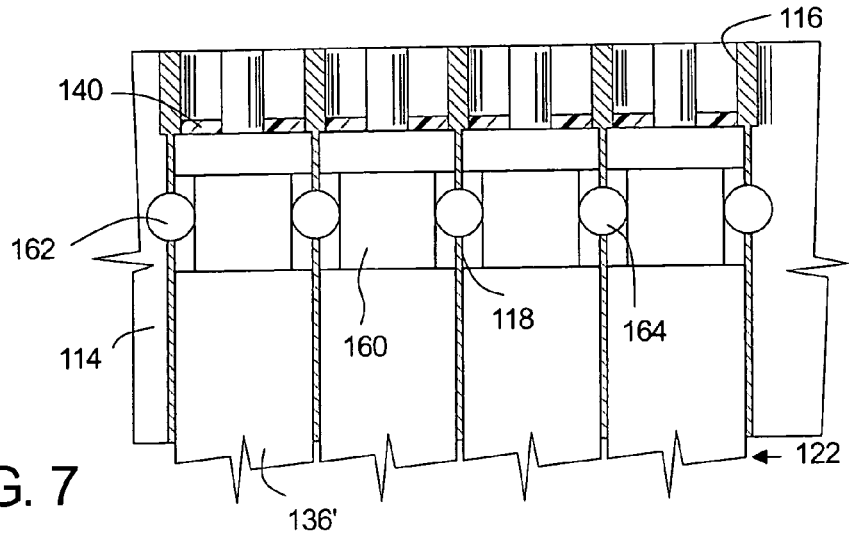
FIG. 7 is a partial sectional view of the positioning member of a second interconnect system embodying the present invention.
Figure 8:
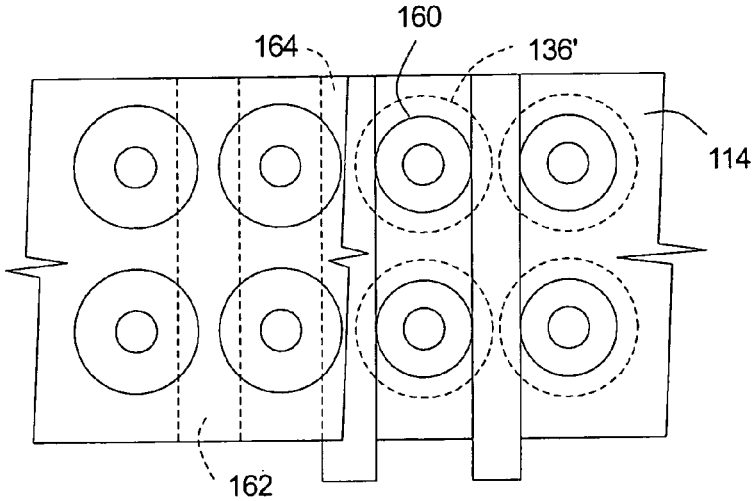
FIG. 8 is a top plan view of the positioning member shown in FIG. 7.

In the case of the embodiment described with reference to FIGS. 4–6, the ends of the coaxial cables 122 may be secured to the positioning block 114 by solder, for example. Use of a bonding mechanism such as solder might not be considered ideal in all circumstances, since it might then prove difficult to remove a defective cable. FIGS. 7 and 8 illustrate an alternative mechanism for positioning and securing the ends of the coaxial cables 122 in the positioning block 114. As shown in FIG. 7, each cable is provided with a metal sleeve 136' having a reduced diameter neck portion 160 just below the centering disc 140. The positioning block is formed with narrow transverse bores 162 between the counterbored portions 118 of each two adjacent bores 116. In order to assemble the coaxial cables to the positioning block, the cables are inserted in the respective bores 116 and are positioned so that the ends of the cables are flush with the upper surface of the positioning block, and then pins 164 are inserted in the transverse bores 162. The diameters of the pins are selected so that the pins are in firm pressure contact with the sleeve 136' at the location of the neck portion 160 and accordingly the pins serve to hold the sleeves securely in position relative to the positioning block. Use of a mechanical interaction to secure the sleeves relative to the positioning block is advantageous, since in the event of a defective cable it allows the defective cable to be removed and replaced rather than necessitating that the entire cable assembly, comprising the coaxial cables and the positioning block, be replaced.

Figure 9:
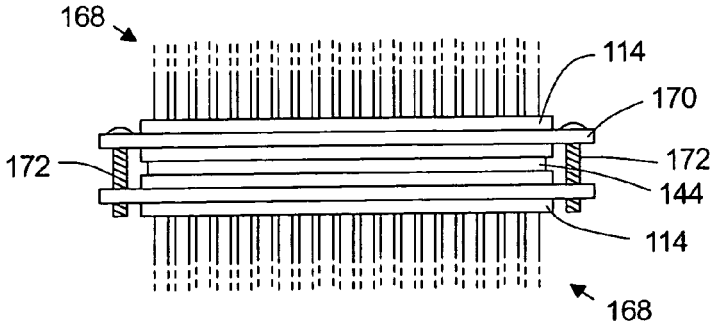
FIG. 9 is a side view of a third interconnect system embodying the present invention.

The combination of a positioning block having coaxial cables secured thereto and a contact device employing a land grid array may be used in other applications than for providing connections directly to the DIB. For example, it may be desirable that a cable bundle that links tester channels to signal traces of the DIB be in two segments, so that the DIB can be removed from the tester without detaching the cables from the DIB or detaching the cables from the tester channels. In this case, referring to FIG. 9, the cable bundle may be provided between its ends with a releasable connector that comprises two positioning blocks 114, connected to the cables of the two cable bundle segments 168 respectively, a contact device 144 employing a land grid array, and suitable mounting hardware 170 and fasteners 172 (illustrated, by way of example, as screws) for securing the two positioning blocks together. In this case, the inner conductor of each cable in one bundle segment is axially aligned with the inner conductor of a corresponding cable in the other bundle segment and a first array of resilient contact elements in the contact device 144 establish electrical contact between the inner conductors of each two corresponding cables. The outer conductors of the cables in the two bundle segments are electrically connected to the respective positioning blocks and the two positioning blocks are electrically connected by a second array of contact elements in the contact device 144. Further, in the event that the cables are to be connected to traces of a circuit board, the invention is not limited to the positioning block being held relative to the circuit board in the manner described with reference to FIGS. 4–6. For example, the positioning block could be secured to the circuit board by use of an individual frame in which the positioning block is mounted and which is attached to the circuit board by screws or other fastening elements. Naturally, the embodiment shown in FIG. 9 is not restricted to the fasteners 172 being screws.

It will be appreciated that the invention is not restricted to the particular embodiments that have been described, and that variations may be made therein without departing from the scope of the invention as defined in the appended claims and equivalents thereof. For example, although an embodiment of the invention has been described with reference to use of C-shaped metal spring contacts, other forms of contact elements may be used instead. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated.

What is claimed is:

1. An interconnection structure including:

a positioning member having a main face and formed with a passage that opens at said main face, a dielectric substrate having a first conductive element on a main face thereof, a coaxial cable having an inner conductor, an outer conductor, and dielectric material between the inner conductor and the outer conductor, wherein the coaxial cable has an end segment that is fitted in the passage in the positioning member and the positioning member is so positioned relative to the dielectric substrate that an end face of the inner conductor is presented towards the first conductive element, and a discrete resilient contact element interposed between the end face of the inner conductor and the first conductive element and in direct electrically conductive pressure contact with both the inner conductor and the first conductive element, the contact element being in a state of compression between the end face of the inner conductor and the first conductive element.

2. An interconnection structure according to claim 1, wherein the positioning member is electrically conductive, the dielectric substrate has a second conductive element on said main face thereof, and the structure further includes a second discrete resilient contact element interposed between the main face of the positioning member and the second conductive element and in electrically conductive pressure contact with both the positioning member and the second conductive element.

3. An interconnection structure according to claim 1, wherein the coaxial cable is an air dielectric coaxial cable.

4. An interconnection structure according to claim 3, wherein the positioning member is electrically conductive, the dielectric substrate has a second conductive element on said main face thereof, and the structure further includes a second discrete resilient contact element interposed between the main face of the positioning member and the second conductive element and in electrically conductive pressure contact with both the positioning member and the second conductive element.

5. An interconnection structure including:

a positioning member having a main face and formed with a plurality of passages that open at said main face, a dielectric substrate having a plurality of first conductive elements on a main face thereof, the main face of the dielectric substrate being presented towards the main face of the positioning member, a plurality of coaxial cables each having an inner conductor, an outer conductor, and dielectric material between the inner conductor and the outer conductor, wherein each coaxial cable has an end segment that is fitted in a passage in the positioning member and the inner conductors of the coaxial cables have respective end faces that are presented towards the first conductive elements respectively, and a plurality of first discrete resilient contact elements interposed between the end faces of the inner conductors respectively and the first conductive elements respectively and each in a state of compression between one of said first conductive elements and one of said inner conductors.

6. An interconnection structure according to claim 5, wherein each coaxial cable is an air dielectric coaxial cable and the inner conductor projects beyond the outer conductor and has a tip that is substantially flush with the main face of the positioning member.

7. An interconnection structure according to claim 5, comprising a retainer member located between the positioning member and the dielectric substrate, wherein the retainer member is formed with apertures and the contact elements are located in the apertures respectively.

8. An interconnection structure according to claim 5, wherein The first conductive elements on the main face of the dielectric substrate are distributed in a first rectangular array and the dielectric substrate has a plurality of second conductive elements on said main face thereof, distributed in a second rectangular array that is displaced from the first rectangular array, and the structure comprises a plurality of second discrete contact elements interposed between the main face of the positioning member and the second conductive elements respectively.

9. An interconnection structure including:

an electrically-conductive positioning member having a main face and formed with a plurality of passages that open at said main face, and a plurality of coaxial cables each having an inner conductor, an outer conductor, and dielectric material between the inner conductor and the outer conductor, wherein the coaxial cables have respective end segments that are respectively fitted in the passages in the positioning member and the inner conductors are substantially flush with the main face of the positioning member.

10. An interconnection structure according to claim 9, wherein the coaxial cable is an air dielectric coaxial cable and the projecting portion of the inner conductor is spaced from the interior of the passage in the positioning member by an amount such that the characteristic impedance of the signal path is substantially uniform over the entire length of the coaxial cable.

11. An interconnection structure according to claim 9, wherein the coaxial cable is an air dielectric coaxial cable and includes an inner tube of dielectric material and a helical spacer separating the inner tube from the inner conductor, the inner conductor has a tip that projects beyond the inner tube, and the structure includes a dielectric centering disc that fits over the tip of the inner conductor.

12. An interconnection structure according to claim 9, comprising a conductive cap that fits over the tip of the inner conductor and is secured thereto for retaining the dielectric centering disc in position against the inner tube.

13. An interconnection structure according to claim 9, wherein the coaxial cable is an air dielectric coaxial cable and includes an inner tube of dielectric material and a helical spacer separating the inner tube from the inner conductor, and the structure further comprises a sleeve of conductive material that fits over the inner tube and is connected to the outer conductor, the tube being fitted in a passage in the positioning member.

14. An interconnection structure comprising:

a first positioning member having a main face and formed with a plurality of passages that open at said main face, a first plurality of conductors having respective end segments that are respectively fitted in the passages in the first positioning member and are substantially flush with the main face of the first positioning member, a second positioning member having a main face and formed with a plurality of passages that open at said main face, a second plurality of conductors having respective end segments that are respectively fitted in the passages in the second positioning member and are substantially flush with the main face of the second positioning member, a means for securing the first and second positioning members with their respective main faces in confronting relationship, and a plurality of discrete resilient contact elements interposed between the main faces of the first and second positioning members and each in electrically conductive pressure contact with one conductor of the first plurality and one conductor of the second plurality.

15. An interconnection structure according to claim 14, comprising a retainer member located between the first and second positioning members, wherein the retainer member is formed with apertures and the contact elements are located in the apertures respectively.

16. An interconnection structure according to claim 14, wherein the conductors are inner conductors of respective coaxial cables each comprising said inner conductor, an outer conductor, and dielectric material between the inner and outer conductors.

17. An interconnection structure according to claim 16, wherein each coaxial cable is an air dielectric coaxial cable and the inner conductor projects beyond the outer conductor and has a tip that is substantially flush with the main face of the positioning member.

* * * * *